US008651314B2

(12) United States Patent
Lin

(10) Patent No.: US 8,651,314 B2
(45) Date of Patent: Feb. 18, 2014

(54) FOAM TANK STRUCTURE IMPROVEMENT

(76) Inventor: I Hsing Lin, Taipei Hsien (TW)

( * ) Notice: Subject to any disclaimer, the term of this patent is extended or adjusted under 35 U.S.C. 154(b) by 848 days.

(21) Appl. No.: 12/840,316

(22) Filed: Jul. 21, 2010

(65) Prior Publication Data

US 2012/0018339 A1 Jan. 26, 2012

(51) Int. Cl.
*F17C 1/00* (2006.01)

(52) U.S. Cl.
USPC ..... 220/581; 220/723; 220/567

(58) Field of Classification Search
USPC ..... 220/565, 567, 1.6, 495.05, 581; 206/524.3; 169/66
See application file for complete search history.

(56) References Cited

U.S. PATENT DOCUMENTS 1,748,992 A * 3/1930 Pirsch ..... 169/78
2,758,747 A * 8/1956 Stevens ..... 220/530
3,286,878 A * 11/1966 Schadt et al. ..... 220/723
3,658,080 A * 4/1972 Mitchell ..... 137/1
3,747,800 A * 7/1973 Viland ..... 220/723
4,541,765 A * 9/1985 Moore ..... 414/267
5,913,451 A * 6/1999 Madison ..... 220/723
6,068,152 A * 5/2000 Meiners et al. ..... 220/1.6
2005/0184068 A1* 8/2005 Moizumi ..... 220/1.6
2008/0164261 A1* 7/2008 Weber et al. ..... 220/560.03

* cited by examiner

*Primary Examiner* — Anthony Stashick
*Assistant Examiner* — Christopher McKinley
(74) *Attorney, Agent, or Firm* — Bacon & Thomas, PLLC

(57) ABSTRACT

A foam tank structure includes a foam tank, a bag and a foam tube, in which the foam tank is equipped with a manhole and a hole cover, and the upper and lower tank walls are individually placed with a foam injection hole, an inlet opening and a drain opening; the bag is integrated with the hollow bag body within the foam tank, and the upper and lower ends individually connect with a foam injection hole, particularly, the bag has double bag walls forming interlayer space therebetween, and plural anti-wear items integrate within the interlayer space; and the foam tube is installed within the bag and connects the foam injection hole of the foam tank, and plural open-apertures are placed at the tube wall; thereby providing a foam tank structure which improves the durability and operating life of the bag.

11 Claims, 10 Drawing Sheets

FOAM TANK STRUCTURE IMPROVEMENT

BACKGROUND OF THE INVENTION (a) Field of the Invention

The present invention relates to a foam tank structure improvement, especially to a foam tank structure improvement exclusively for filling fire fighting foam liquid.

(b) Description of the Prior Art

The conventional foam tank internally combines a bag, the bag filled with the foam liquid is installed with a foam tube with single tube shape therein, the foam tube connects with the external fire-fighting equipment, and a water inlet is placed at the upper end of the foam tank, after the water is input from the water inlet to fill the foam tank, the foam liquid within the bag is compressed to be output through the foam tube to the external fire-fighting equipment. However, the conventional bag does not have anti-wear and floating design, and the water input from the water inlet directly falls on and impacts the bag, thus it can easily lead to bag breakage. Moreover, the foam tube has considerable length, is made of metal material or other hard materials to be an extended long tube, and cannot be divided and dismantled, thus it is not convenient for the foam tube to be repaired or replaced, and the structure of the conventional foam tank still needs for improvement.

SUMMARY OF THE INVENTION

The main object of the present invention is to provide a foam tank structure improvement, through the bag structure improvement in the foam tank, the bag has anti-wear and floating item, to prevent the bag from friction damage, and to achieve the object of improving the floating property of the bag after being filled up.

The secondary object of the present invention is to provide a foam tank structure improvement, through the guided ring design in the foam tank, the water from the water inlet inputs the foam tank through the guided ring, to prevent the bag from being directly impacted, and to achieve the object of improving the operating life of the bag.

In order to achieve the above objects, the components of the present invention include: a foam tank, in which a manhole and a hole cover 14 are placed at one or two side tank walls, and a foam injection hole, an inlet opening, and a drain opening are individually placed at the upper and lower tank walls; a bag, which is a cross shape hollow bag body installed within the foam tank, in which the upper and lower ends individually connect with the foam injection holes, and the bag has double bag walls forming interlayer space therebetween, and plural anti-wear floating items integrate within the interlayer space; and a foam tube, which defines a cross form tube body, and integrated within the bag, in which the upper and lower ends individually connect to the foam injection holes of the foam tank, and the tube wall is installed with plural open-apertures.

DETAILED DESCRIPTION OF THE PREFERRED EMBODIMENTS

Figure 1:
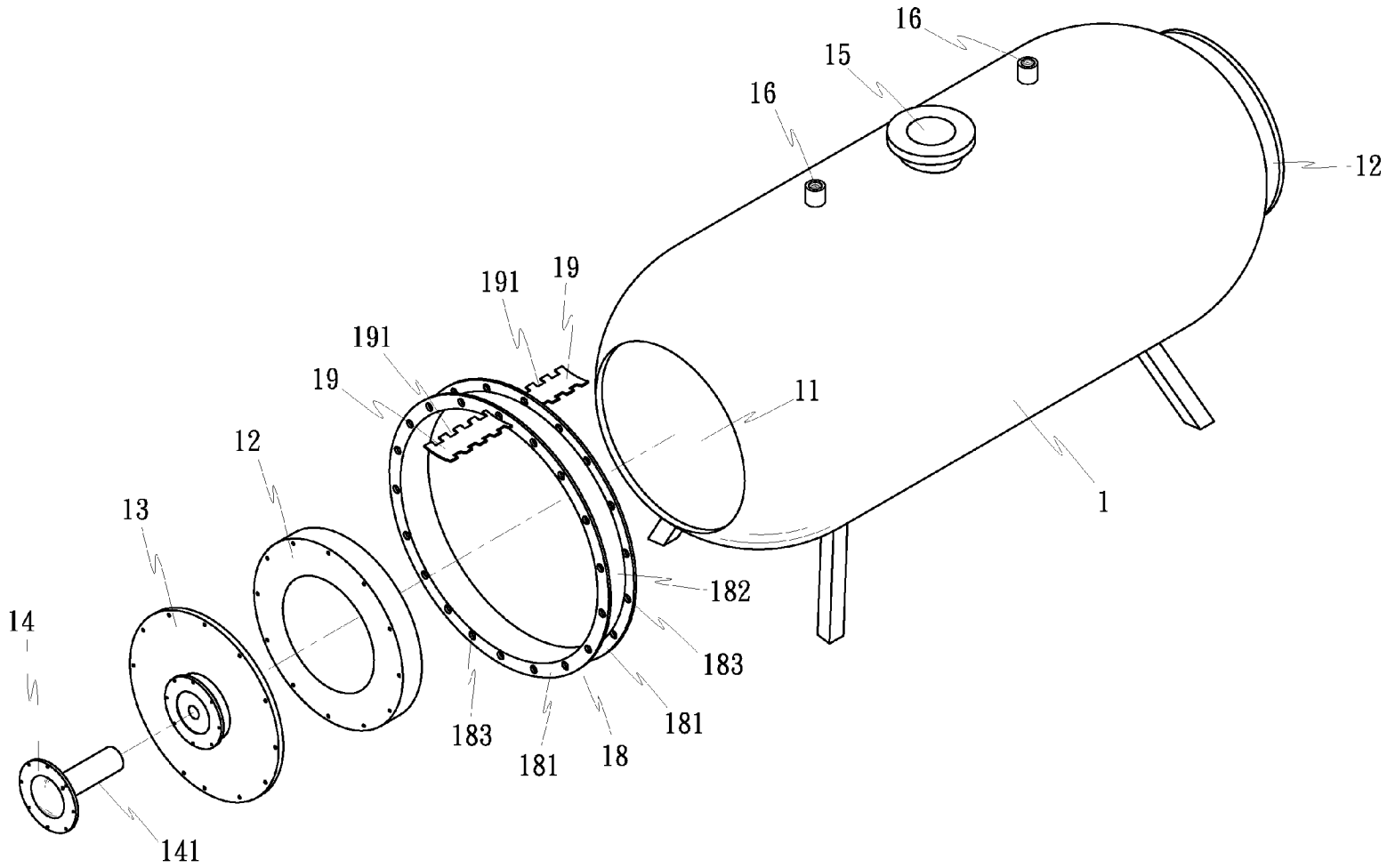
FIG. 1 is a three-dimensional exploded view showing the preferred embodiment of the overall structure of the present invention.
Figure 2:
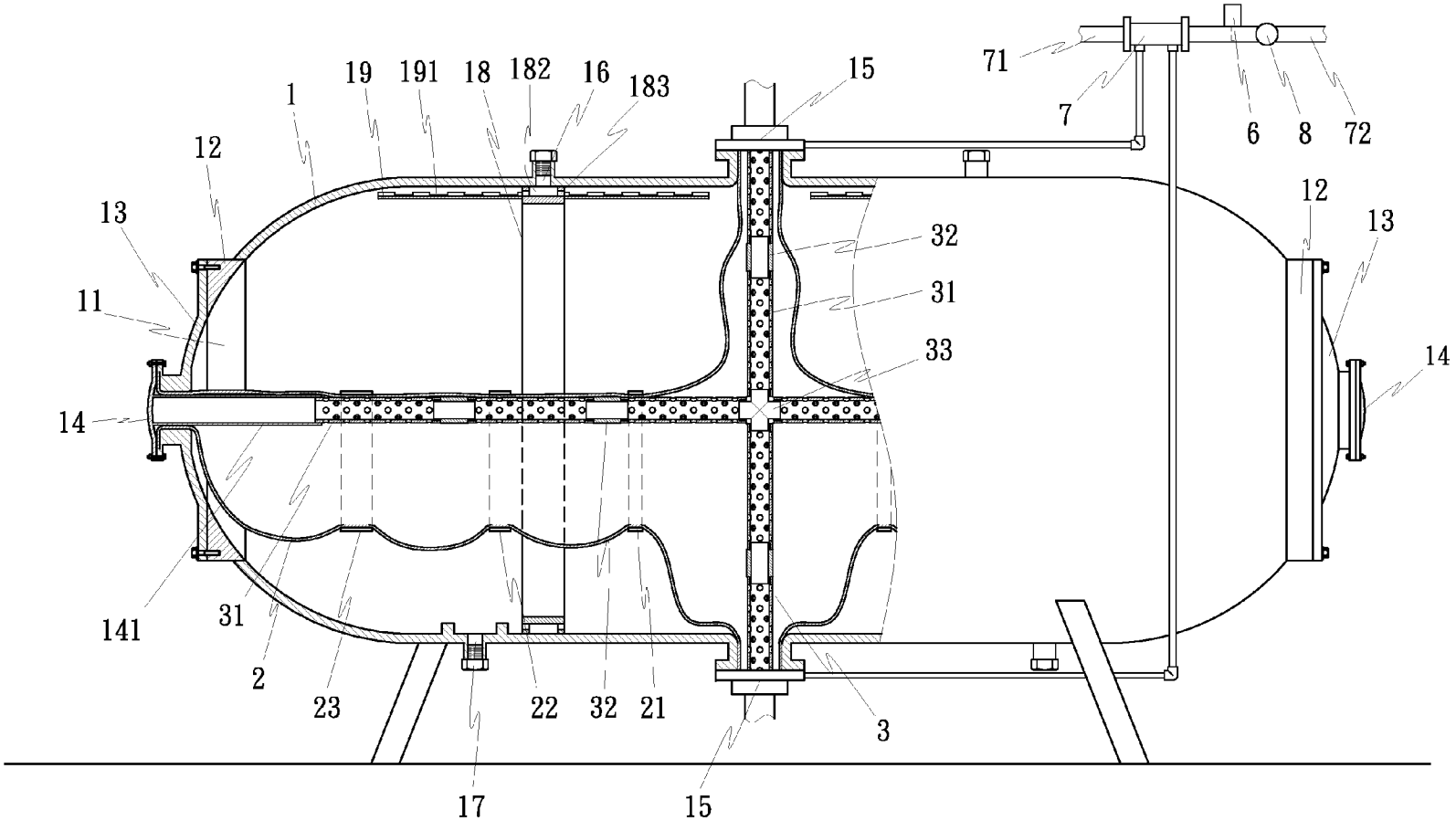
FIG. 2 is a composition cross-section view showing the preferred embodiment of the overall structure of the present invention.
Figure 3:
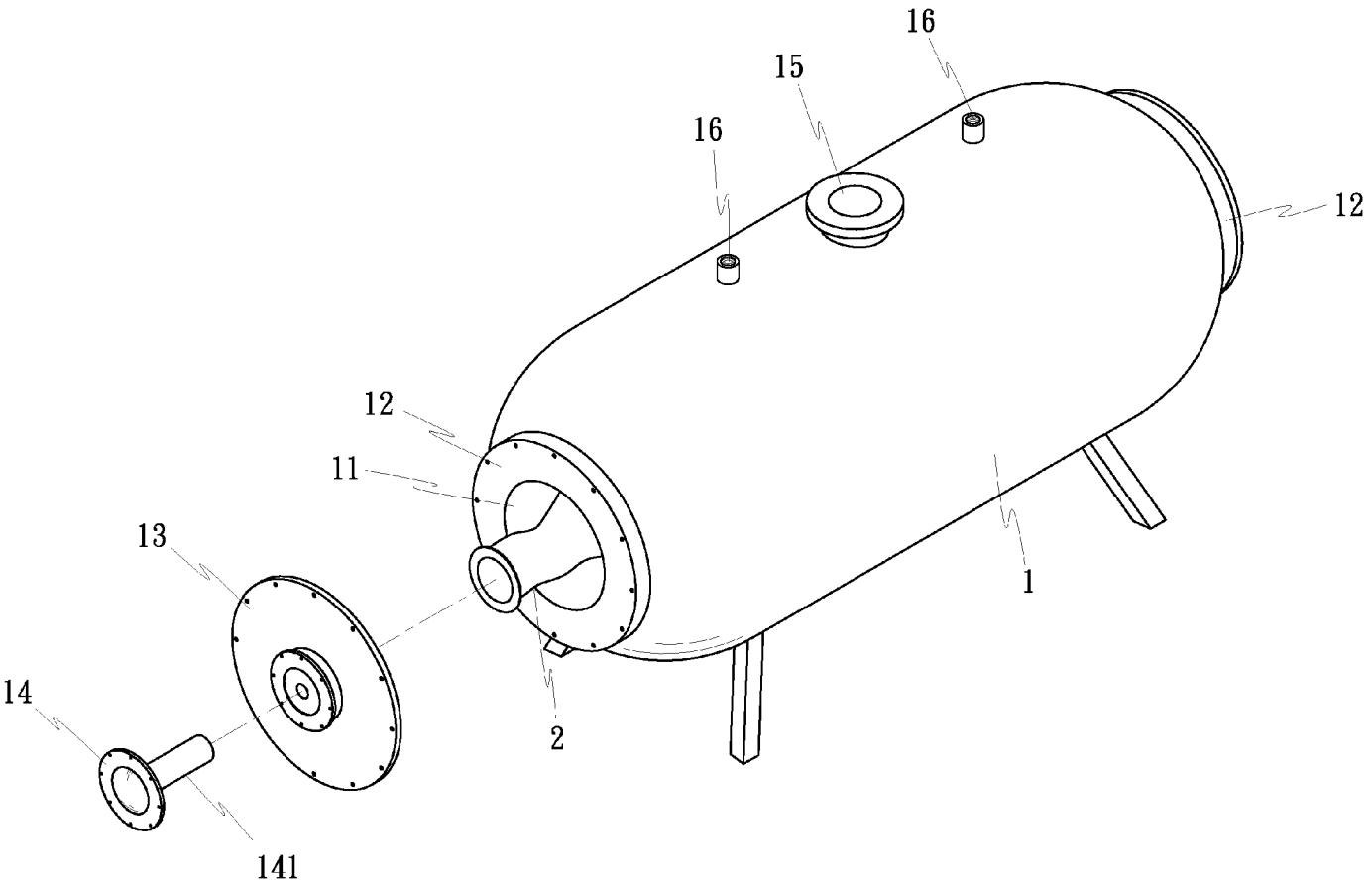
FIG. 3 is a three-dimensional exploded view showing the preferred embodiment of the manhole of the present invention.
Figure 4:
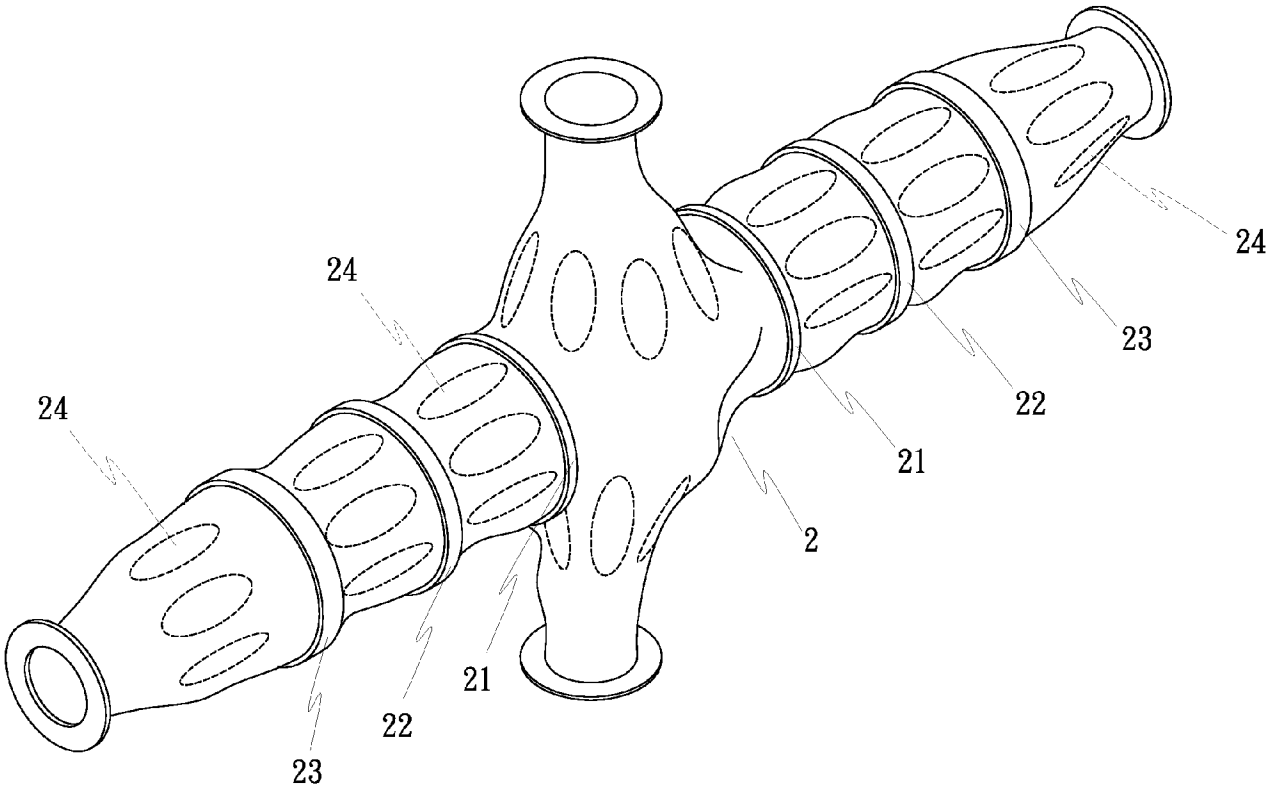
FIG. 4 is a three-dimensional view showing the preferred embodiment of the bag of the present invention.
Figure 5:
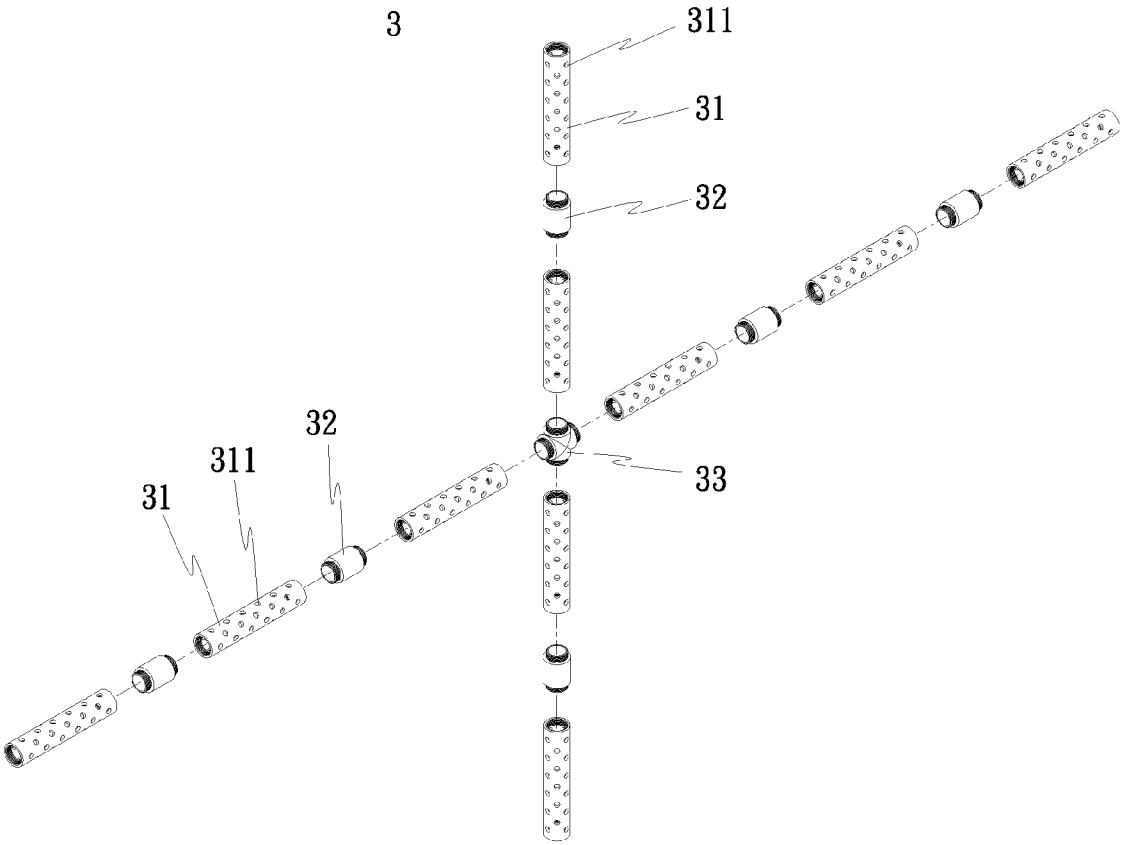
FIG. 5 is a three-dimensional view showing the preferred embodiment of the foam tube of the present invention.
Figure 6:
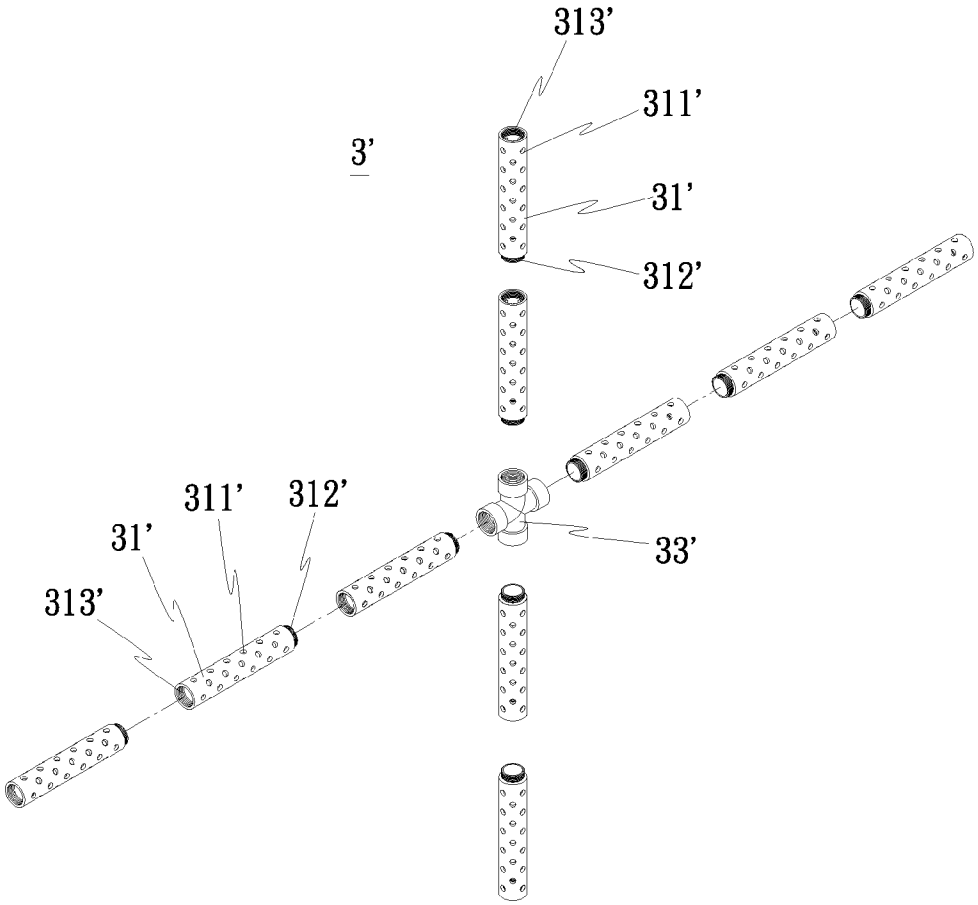
FIG. 6 is a three-dimensional view showing another preferred embodiment of the foam tube of the present invention.
Figure 7:
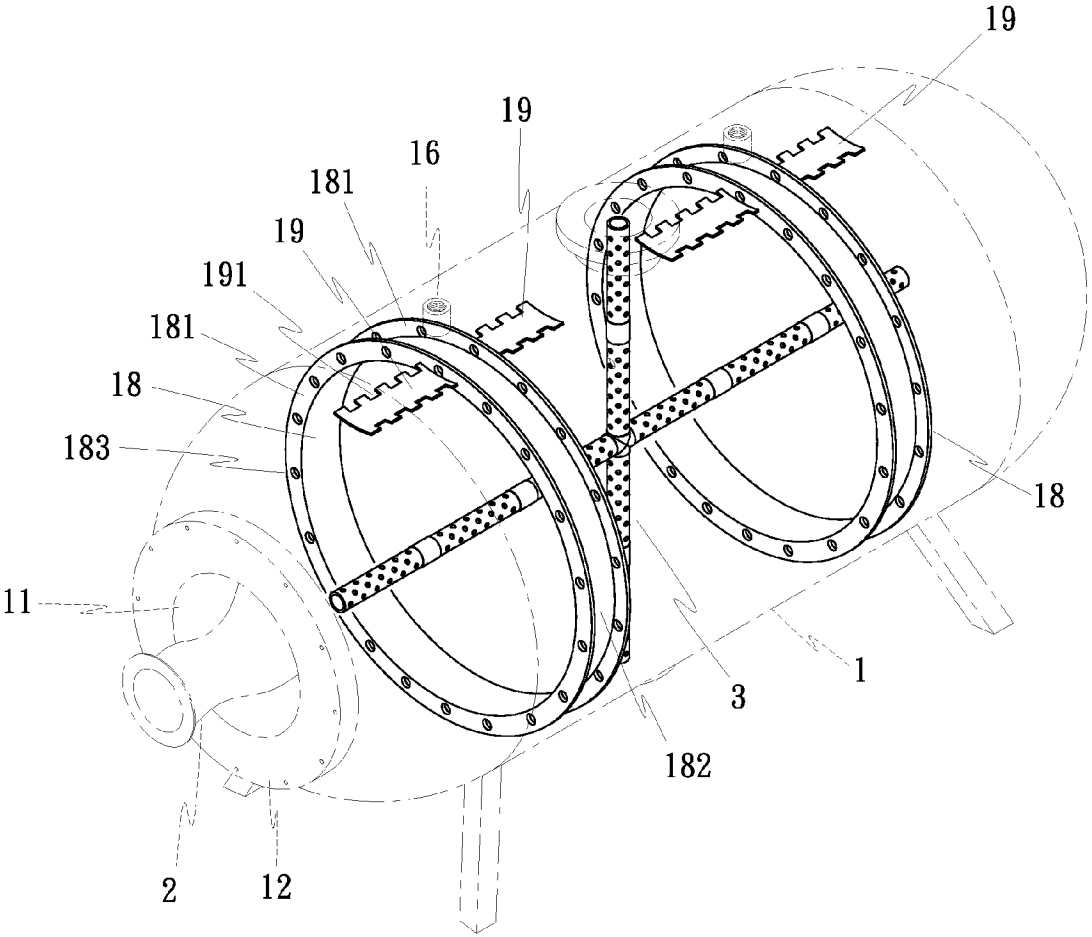
FIG. 7 is a composition perspective view showing the preferred embodiment of the overall structure of the present invention.
Figure 9:
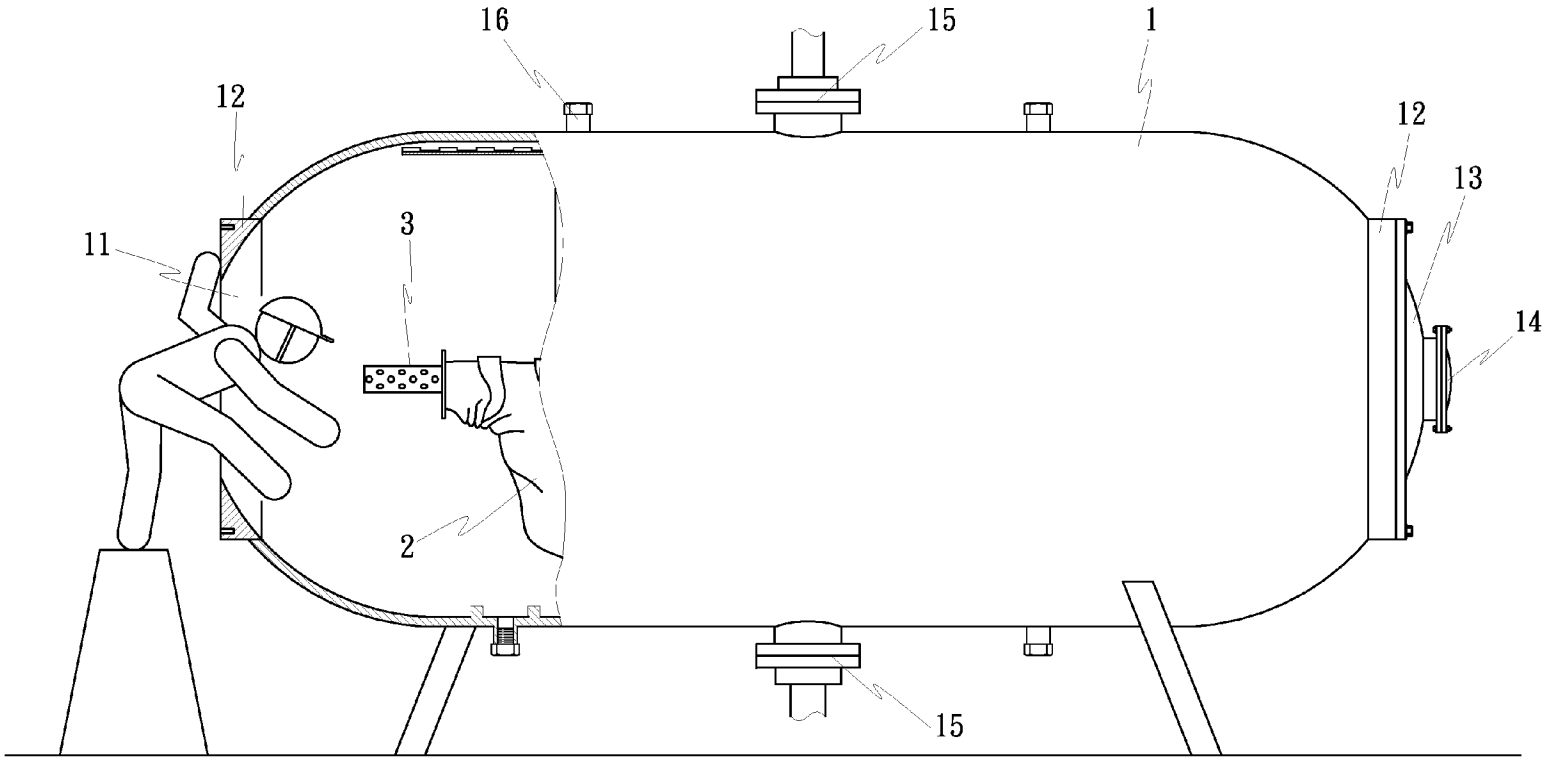
FIG. 9 is a schematic view showing the preferred embodiment of the complement tank of the present invention.

AS shown in the drawings, the foam tank structure improvement of the present invention mainly includes a foam tank 1, a bag 2, and a foam tube 3, in which:

the foam tank 1, as shown in FIG. 1 and FIG. 2, is a large container tank, and a manhole 11 is individually placed at one (as shown in FIG. 9) or two sides thereof, wherein the manhole 11 is sequentially installed with a ring frame 12, a flange unit 13, and a hole cover 14; a convex bushing 141 is installed at the inside center of the hole cover 14; a foam injection hole 15, an inlet opening 16, and a drain opening 17 are individually placed at the upper and lower tank walls of the foam tank 1, and a shunt ring 18 is installed at the inside tank wall of the inlet opening 16; the shunt ring 18 matches the ring body at the inside tank wall of the foam tank 1, a retaining ring 181 is individually outward installed at two sides thereof, and a flume 182 is formed between the two retaining rings 181; plural weep holes 183 are placed at the retaining ring 181, a spreader plate 19 is individually installed at two sides of the top of the shunt ring 18 near the inlet opening 16, and plural notches 191 are placed at two sides of the spreader plate 19;

the bag 2, as shown in FIG. 2, FIG. 3, and FIG. 4, is a cross shape hollow bag body installed within the foam tank 1, the upper and lower ends individually connect with the foam injection holes 15 of the foam tank 1, and one or two ends of the lateral side are locked and closed by the flange unit 12 and the hole cover 14; the outside of the bag 2 is fitted with one or more segments of elastic jackets 21, 22, and 23, from the inner part to the outer part, which are divided into loose (21), sub-compact (22) and the most compact (23), and when the foam is injected, the bag 2 will gradually expand from the inner part to the outer part, to facilitate all the water being drained out of the foam tank 1; the bag 2 has double bag walls forming interlayer space therebetween, and plural anti-wear items 24 integrate within the interlayer space; and the anti-wear item 24 is floating, which is the material with density greater than water or a hollow body; and the foam tube 3, as shown in FIG. 5, in which the preferred embodiment includes plural segments of tubes 31 and annular tube fittings 32, and uses a four-way connector 33 to define a cross component form; the tube wall of every segment of the tube 31 are installed with plural open-apertures 311; as shown in FIG. 6, in another preferred embodiment, a foam tube 3' is constituted by plural tubes 31' connection through directly screwing each other, in which external thread 312' is installed at one end of the tube 31', and internal thread 313' is installed at another end, through the external thread 312' and the internal thread 313' screwing each other, thus the annular tube fittings 32 is not necessary, but the foam tube similarly uses a four-way connector 33' to define a cross component form, and plural open-apertures 311' are similarly placed at the tube wall of every segment of the tube 31'; as shown in FIG. 7, the foam tube 3 is installed within the bag 2, wherein the upper and lower ends individually connect and fix at the foam injection holes 15 placed at the upper and lower tank walls of the foam tank 1, and two side ends individually extend at the inner side of one or two sides of the hole cover 14, and fit with the bushing 141 at the inner side of the hole cover 14; the tubes 31, 31' and the tube fitting 32 are made of metal materials (such as aluminum tubes or other anti-corrosion metal tubes) or other selected hard materials.

Figure 8:
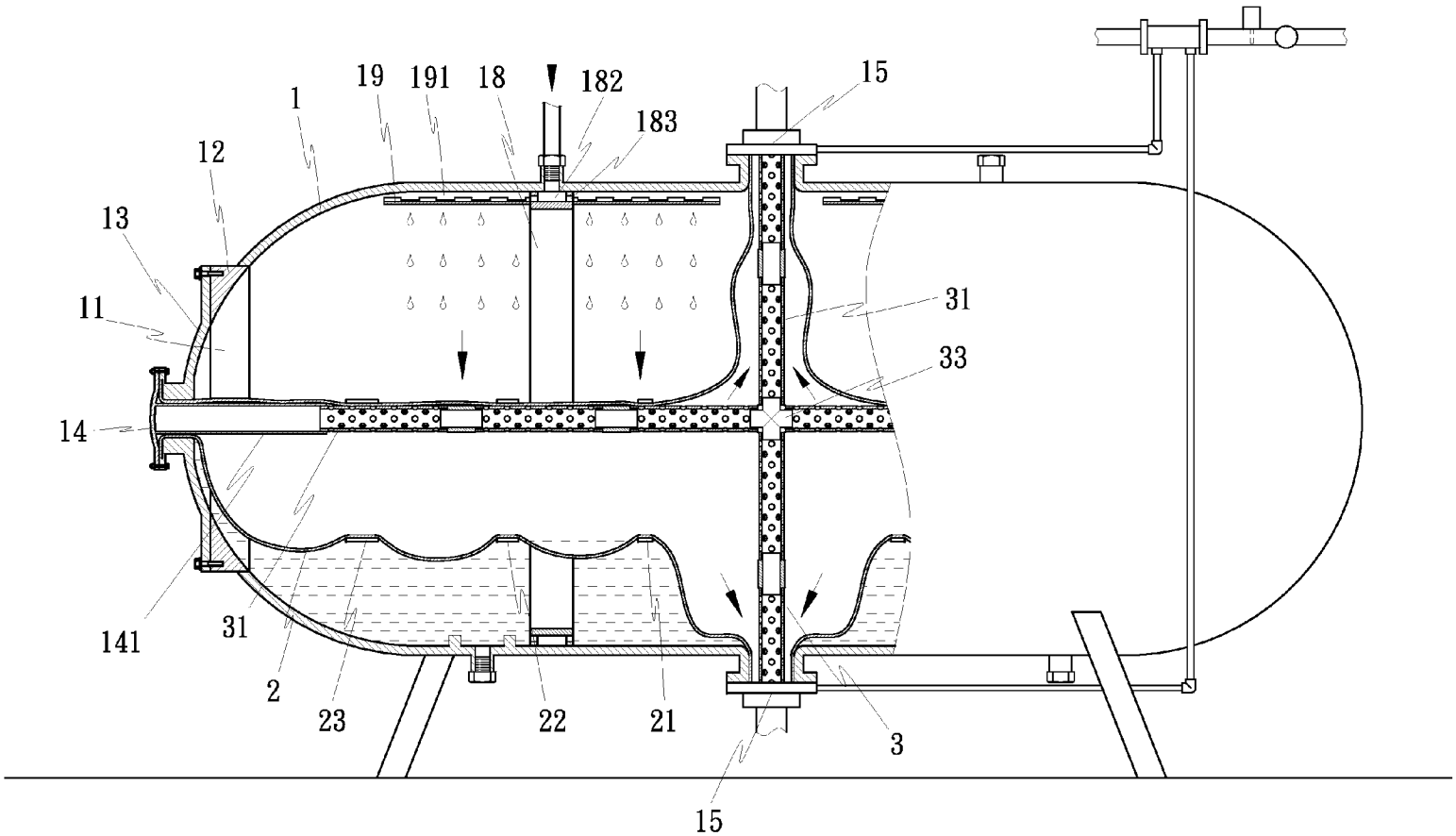
FIG. 8 is a schematic view showing another embodiment and applied operations of the present invention.

As shown in FIG. 8, through the horizontal type foam tank, which can be used for fire appliances, and the fire foam liquid is stored in the bag 2, when the foam liquid is needed to use, water or other liquid can be injected from the inlet opening 16 of the foam tank 1, and the water in the foam tank 1 will compress the space of the bag 2, thus the compaction is produced through coordinating with the elastic jackets 21, 22, and 23, to make the foam liquid flow out of the foam tank 1 through the foam tube 3 and be used for fire-fighting. As shown in FIG. 9, if maintenance is needed, one can enter the foam tank 1 from the manhole 11 for maintenance.

Figure 10:
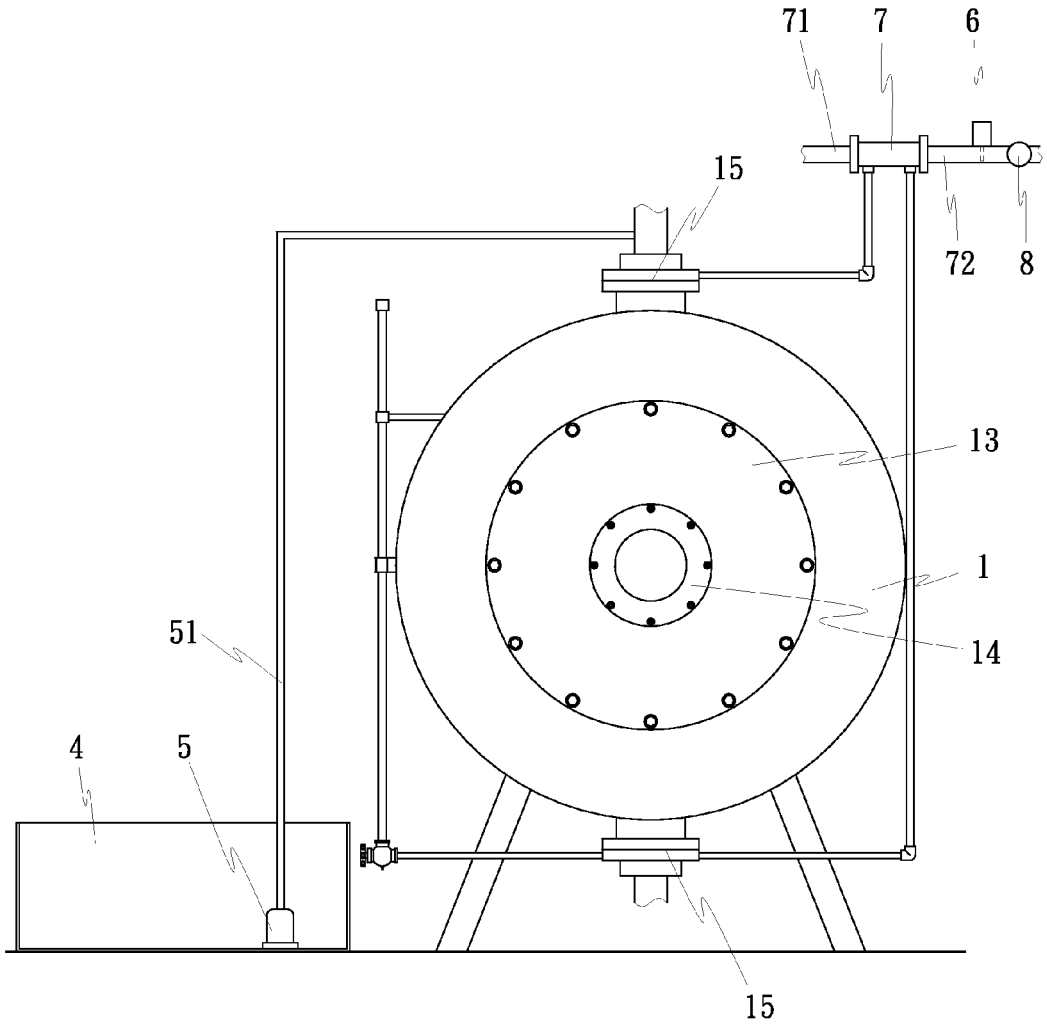
FIG. 10 is a schematic view showing the applied status of entering from the manhole of the present invention.

As shown in FIG. 10, an open type complement tank 4 is installed at the outside of the foam tank 1 of the present invention, a pump 5 is installed at the inside or the outside wall of the complement tank 4, the pump 5 connects with the inside of the complement tank 4, and the pump 5 integrates with a transit tube 51 connecting with the foam injection hole 15. A sensor 6 is installed at the foam tank 1, and the sensor 6 connects with the pump 5 to control the starting and stop for the pump 5. As for the preferred embodiment of the sensor 6, the foam tank 1 is installed with a distribution device 7 for controlling the flow ratio of the foam liquid, the distribution device 7 is a multi-hole connector, and the two end holes individually connect with a water supply pipe 71 and a mixed liquid feed tube 72, for controlling the mixed ratio of the inflow of the water and foam, generally, the water accounts for 94~97% and the foam accounts for 3~6%, or the ratio is free changed as required, to supply the mixed liquid of foam and water with appropriate proportion. Because the mixed liquid feed tube 72 integrates with the sensor 6 and a non-return valve 8, the sensor 6 is used for the flow sensor to detect the flow.

As for the achieved effect of the foam tank structure improvement of the present invention, as shown in FIG. 2 and FIG. 4, through the plural anti-wear items 24 with floating and anti-wear features installed within the bag wall of the bag 2, the double bag walls of the bag 2 can be prevented from friction damage, and the bag 2 can be prevented from being excessively drop-down due to load-bearing; as shown in FIGS. 2, 7 and 8, through the design of the inside tank wall integrated with the shunt ring 18 in the foam tank 1, the water or other liquid input the foam tank 1 through the inlet opening 16 can first dispersedly input from the flume 182 and the weep hole 183 to both sides, and the water right above the bag 2 is distributed to the two sides through the spreader plate 19 and the notch 191 to prevent the bag 2 from being directly impacted by the water or other liquid, so as to protect the bag 2 and extend the operating life of the bag 2.

As shown in FIGS. 2, 5 and 6, the foam tube 3 of the present invention is multi-segment connected to define a cross component form, and the bushing 141 at inside of the hole cover 14 fits with the one or two side ends of the foam tube 3, when a technician plans to enter the foam tank 1 for maintaining or replacement, the flange unit 13 and the hole cover 14 must be disassembled together to disconnect the bushing 141 and one side end of the foam tube 3, and the bag 2 is inward pushed a little, as shown in FIG. 9, thus the space of the manhole 11 for the technician entering the foam tank 1 for inspection, maintaining or replacement is made. As shown in FIG. 10, the complement tank 4, the pump 5 and the sensor 6 are additionally installed at outside of the foam tank 1 of the present invention, and we can set as following, if the flow of the mixed liquid feed tube 72 is reduced or stopped and detected by the sensor 6, the insufficient foam liquid in the bag 2 is identified, then the foam liquid from the complement tank 4 is drawn by the controlled pump 5, and is added into the bag 2 through the transit tube 51 and the foam injection hole 15, thus the effect of adequately supplying the foam liquid is achieved.

What is claimed is:

1. A foam tank structure improvement, including:

a foam tank, in which a manhole and a hole cover is individually placed at one or two side tank walls thereof, and a foam injection hole, an inlet opening, and a drain opening are individually placed at the upper and lower tank walls of the foam tank;

a bag, which is a cross shape hollow bag body installed within the foam tank, and include upper and lower ends which individually connect with the foam injection holes, and the bag has double bag walls forming interlayer space therebetween, and plural anti-wear floating items integrate within the interlayer space;

a foam tube, which defines a cross form tube body, and integrated within the bag, in which the upper and lower ends individually connect to the foam injection holes of the foam tank, and the tube wall is installed with plural open-apertures.

2. The foam tank structure improvement as claimed in claim 1, in which a shunt ring is installed at the inside tank wall of the inlet opening of the foam tank, the shunt ring matches the ring body at the inside tank wall of the foam tank, a retaining ring is individually outwardly installed at each of two sides thereof, a flume is formed between the two retaining rings, and plural weep holes are placed at the retaining ring.

3. The foam tank structure improvement as claimed in claim 2, in which a spreader plate is individually installed at each of two sides of the top of the shunt ring near the inlet opening, and plural notches are placed at two sides of the spreader plate.

4. The foam tank structure improvement as claimed in claim 1, in which the foam tube includes plural segments of tubes and annular tube fittings, the tube wall of every segment of the tube are installed with plural open-apertures, the foam tube uses a four-way connector to define a cross component form, the upper and lower ends individually fix at the foam injection holes placed at the upper and lower tank walls of the foam tank, and two side ends individually extend at the inner side of one or two sides of the hole cover.

5. The foam tank structure improvement as claimed in claim 4, in which a convex bushing is installed at the inside center of the hole cover, and the bushing fits with one side end of the foam tube.

6. The foam tank structure improvement as claimed in claim 1, in which the foam tube includes plural tubes connected through directly screwing each other, wherein external thread is installed at one end of each tube, and internal thread is installed at another end, through the external thread and the internal thread screwing each other, the foam tube uses a four-way connector to define a cross component form, and plural open-apertures are placed at the tube wall of every segment of the tube, thus the upper and lower ends are fixed at the foam injection holes placed at the upper and lower tank walls of the foam tank, and the two side ends individually extend at the inner side of one or two sides of the hole cover.

7. The foam tank structure improvement as claimed in claim 6, in which the convex bushing is installed at the inside center of the hole cover, and the bushing fits with one side end of the foam tube.

8. The foam tank structure improvement as claimed in claim 1, in which a complement tank is installed at the outside of the foam tank, a pump integrates with the complement tank, and the pump integrates with a transit tube connecting with the foam injection hole.

9. The foam tank structure improvement as claimed in claim 8, in which a sensor is installed at the foam tank, and the sensor controls the starting and stop for the pump.

10. The foam tank structure improvement as claimed in claim 9, in which the foam tank is installed with a distribution device for controlling the flow ratio of the foam liquid, the distribution device is a multi-hole connector, and the two end holes individually connect with a water supply pipe and a mixed liquid feed tube, through the mixed liquid feed tube integrating with the sensor, the sensor is used for the flow sensor to detect the flow.

11. The foam tank structure improvement as claimed in claim 10, in which the mixed liquid feed tube integrates with a non-return valve.

* * * * *